United States Patent [19]

McFarlin

[11] Patent Number: 4,637,416

[45] Date of Patent: Jan. 20, 1987

[54] INTEGRAL LIGHTWEIGHT TENT AND BOX FOR PORTABLE APPLICATIONS

[76] Inventor: Terry McFarlin, 16536 Sharon, Chesaning, Mich. 48616

[21] Appl. No.: 666,250

[22] Filed: Oct. 29, 1984

[51] Int. Cl.[4] ..... E04H 15/48; E04H 15/60; E04H 15/30

[52] U.S. Cl. ..... 135/109; 135/114; 135/95

[58] Field of Search ..... 135/106, 107, 108, 109

[56] References Cited

U.S. PATENT DOCUMENTS

| | | | |
|---|---|---|---|
| 1,408,284 | 2/1922 | Galloway | 135/106 |
| 1,629,326 | 5/1927 | Robert | 135/87 |
| 2,546,588 | 3/1951 | Ellis | 135/106 |
| 2,804,876 | 9/1957 | Bowen et al. | 135/106 |
| 2,853,086 | 9/1958 | Biagosch | 135/106 |
| 2,876,783 | 3/1959 | Ames | 135/106 |
| 2,970,600 | 2/1961 | Schultz | 135/107 |
| 3,173,436 | 3/1965 | Peters | 135/109 |
| 3,228,406 | 1/1966 | Jamba | 135/109 |

*Primary Examiner*—Robert A. Hafer
*Assistant Examiner*—D. Neal Muir
*Attorney, Agent, or Firm*—Marshall G. MacFarlane

[57] ABSTRACT

An integral tent and container for portable applications, where the container, when opened, forms an integral support portion and covering portion of the erected enclosure.

5 Claims, 5 Drawing Figures

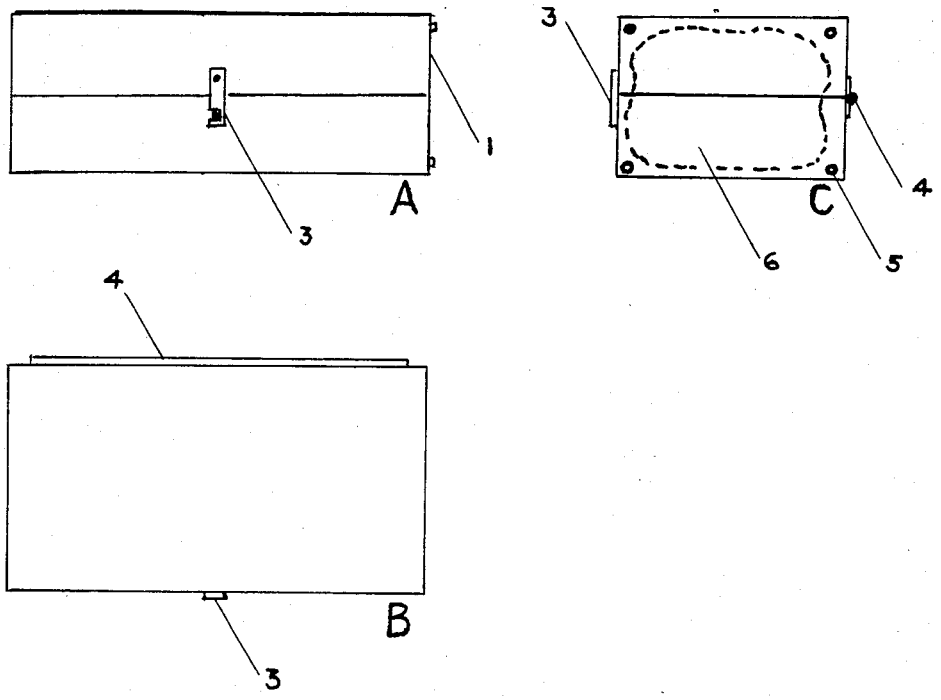
FIGURE 1
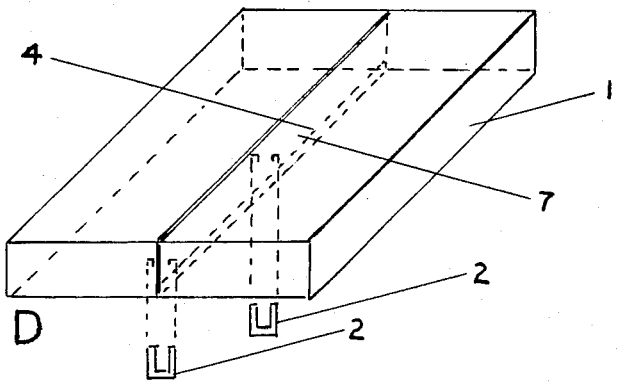

INTEGRAL LIGHTWEIGHT TENT AND BOX FOR PORTABLE APPLICATIONS

BACKGROUND OF THE INVENTION

1. Field of the Invention

The present invention relates generally to tents, and more particularly describes a portable, lightweight tent, which has, for transportation, a lightweight and compact rectangular container, which, when opened, forms an integral support-portion and covering-portion of the erected enclosure.

2. Description of the Prior Art

A lightweight and portable personal enclosure has been a useful and desirable item for the soldier, hiker, cyclist and motorist. Because of the inherent vulnerability of the fabrics often used in such enclosures, it has also been an object of the invention to integrate an enclosure such as that previously described, with a sturdy and protective container.

A knapsack tent is described and illustrated in U.S. Pat. No. 39,150 to L. Joubert. A tent in which the rectangular hinged container serves as the floor is described in U.S. Pat. No. 143,037 to J. B. Smith. However, in that case, a relatively large container, 40 inches wide and 5½ feet long is required and, because its designation as a "floor" dictates the maximum size of the enclosure, it restricts the portability of the combination.

More recently, a sunshade awning with the awning material also comprising the outside of the container is found in U.S. Pat. No. 2,853,086 to A. J. Biagosch, but the soft material provides only limited protection.

All of the foregoing inventions have limitations either in their enormous size, or the lack of a durable and protective container which can also serve as a useful portion of the completed enclosure.

Consequently, a need exists for improvements in such portable enclosures which will result in improved protection for the fabric of the enclosure, the absence of limitation in the size of the completed tent, and the utilization of the container as an effective structural portion of the completed enclosure.

SUMMARY OF THE INVENTION

The present invention provides a portable personal enclosure to satisfy the aforementioned needs. The invention embodies a lightweight plastic container, such as fiberglass reinforced plastic or ABS plastic as a portion of the top of the enclosure.

The present invention relates to a unified personal enclosure having lightweight Dacron or nylon side panels, a collapsable or segmented single center support, corner stakes, and a hinged rectangular container which, when opened, forms the top portion of the completed enclosure, as well as providing structual support to the upper portion of each of the side panels of the completed tent. In addition, the enclosure is equipped with an openable flap for entry and exit, and the container is of sufficient size to hold all tent fabric, the segmented or telescoping center pole, as well as the ground stakes, and still presents an extremely lightweight and portable package when in its collapsed and hinged configuration.

BRIEF DESCRIPTION OF THE DRAWINGS

FIG. 1 shows four separate views of the container, FIGS. 1A, 1B and 1C show the front elevation, top and side views of the container respectively, while FIG. 1D shows the container in perspective, unfolded in preparation for mounting the tent fabric.

DESCRIPTION OF THE PREFERRED EMBODIMENTS

Figure 2:
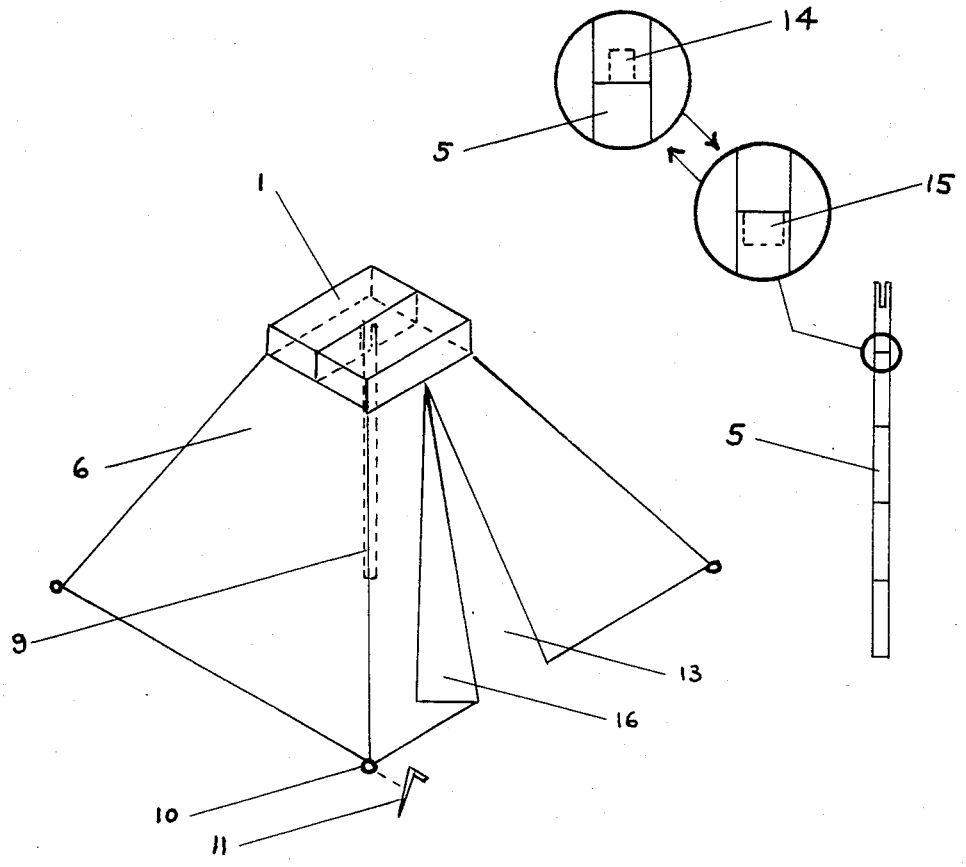
FIG. 2 is a prospective view of the completed enclosure, as well as a side view of the segmented or telescoping center pole, with two detail drawings of the junction of the segmented or telescoping sections.

Referring now to the drawings, and more particularly to FIG. 1, there is a container (1) of relatively compact size (typically, twelve to eighteen inches in length, four to six inches in width, and three to five inches in depth), which consists of two identical half sections, each comprising a five-sided box, which sections are placed together in such a fashion so that the open portion of each box is mated precisely, and one side of the mated pair is secured together with a hinging device (4). The side of the paired boxes which is disposed directly opposite the aforedescribed hinge is equipped with a latching mechanism (3). Multiple "U" shaped clips (2) are provided for holding container (1) in its open positiion.

In the preferred embodiment of the container, the tent fabric (6), the tent center pole segments or telescoping center pole (5), and the tent stakes (11), are collapsed and placed in the container (1), which is closed with latch (3).

For erection of the completed structure, the latch (3) is freed, and the container is opened fully, to permit removal of the contents. The faces of the container are fully opened as in FIG. 1D, so that the faces of the container to which the hinge flaps are attached become directly in contact. Clips (2) are inserted over the mated sides of the container to secure the container in open position, creating a more or less rigid container open on one side, and approximately square in shape.

The tent walls (6) are then attached to the (inside/-outside) walls of the now unfolded container, and the fabric is secured at corner points (10) with stakes (11). A collapsable or segmented center pole (9) is then extended. The upper segment of said center support is equipped with means to permit it to be secured to the center of the unfolded container. The center pole may be either segmented, with multiple pieces (5), equipped with pin and socket juncture (14) or may be a single telescoping pole equipped with telescoping junctions (15). The extended or assembled center pole is then pushed into position inside the enclosure, resulting in a more or less pyramid-shaped personal enclosure, equipped with an entry opening (13) and closure (16).

I claim:

1. A portable personal enclosure comprising a rectangular container in the form of a hinged box, said box hinged at the approximate center of one side so that when said box is opened completely, the halves of said side abut to form a double thick center element, said box having sufficient volume to contain the remaining elements of said enclosure, said elements comprising a plurality of collapsible fabric walls, a plurality of stakes for securing said fabric to the ground, a collapsible central support member having at its upper end a slot for receiving said double thick center element, and additional means for retaining the hinged box in a fixed and open configuration.

2. A portable personal enclosure as described in claim 1, wherein said container constitutes the top supporting portion of the completed enclosure.

3. A portable personal enclosure as described in claim 2, wherein said portable personal enclosure further comprises a synthetic fabric tent with multiple side panels and, wherein the collapsible fabric walls of the enclosure are trapezoidal in shape, and are attached to the container at the upper edge of said walls, and wherein the opposing edge of said fabric walls are provided with a corner attach point for securing each edge of said walls to the earth.

4. A portable personal enclosure as recited in claim 2, wherein said portable personal enclosure further comprises a synthetic fabric tent with multiple side panels and, a collapsible center support with means for engaging the aforedescribed container, the upper end of which comprises means to engage said support to said double thick center element, and further comprising a plurality of "C" shaped clips for maintaining the mated faces of the container in an open configuration.

5. A portable personal enclosure comprising a rectangular container, in the form of a hinged box, said box hinged at the approximate center of one side so that when said box is opened completely, the halves of said side abut to form a double thick center element, said box having sufficient volume to contain the remaining elements of said enclosure, said elements comprising a plurality of collapsible fabric walls, a plurality of stakes for securing said fabric to the ground, a collapsible central support member having at its upper end an aperture for receiving the double thick center element formed when the box is opened, and further comprising a plurality of "C" shaped clips for engaging and maintaining the double thick center support element by an interference fit and maintaining the container in an open configuration.

* * * * *